United States Patent [19]

Shor

[11] Patent Number: 4,612,093

[45] Date of Patent: Sep. 16, 1986

[54] METHOD AND APPARATUS FOR PURIFICATION OF GOLD

[75] Inventor: Peter S. Shor, New York, N.Y.

[73] Assignee: Shor International Corporation, New York, N.Y.

[21] Appl. No.: 740,133

[22] Filed: May 31, 1985

[51] Int. Cl.[4] ..... C25C 1/06

[52] U.S. Cl. ..... 204/111; 204/263; 204/264; 75/118 R; 106/1.26; 423/34; 423/38; 423/41

[58] Field of Search ..... 204/130, 140, 109, 111, 204/263, 264; 106/1.26; 423/38, 34, 41; 75/118 R

[56] References Cited

U.S. PATENT DOCUMENTS 2,017,330 10/1935 Traphagen ..... 204/111
4,113,471 9/1978 Langhorst et al. ..... 204/111

*Primary Examiner*—R. L. Andrews
*Attorney, Agent, or Firm*—Wolder, Gross & Yavner

[57] ABSTRACT

A novel gold purification method is provided which comprises electrolyzing gold into a novel pregnant electrolyte, segregating the dissolved gold ions from the cathode by a semipermeable barrier, separating insoluble impurities from the gold-containing liquidus, and then selectively reducing the gold to metallic form from the liquidus by a selective chemical reducing agent. The electrolyte is impregnated with a catalyst for leveling the overvoltage of gold and preferably contains a peroxide or a nascent oxygen source. A unitary apparatus for the method is provided.

17 Claims, 3 Drawing Figures

Fig.1.
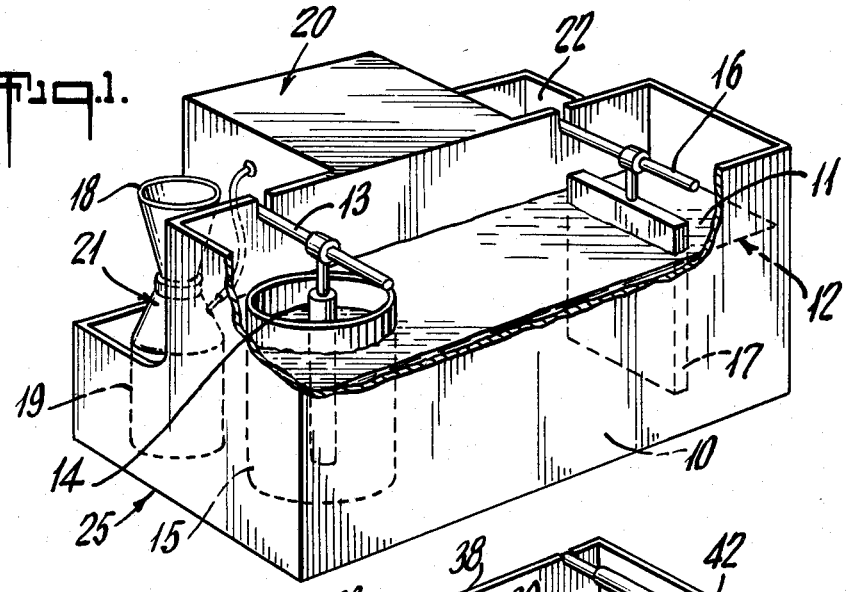
Fig.2.
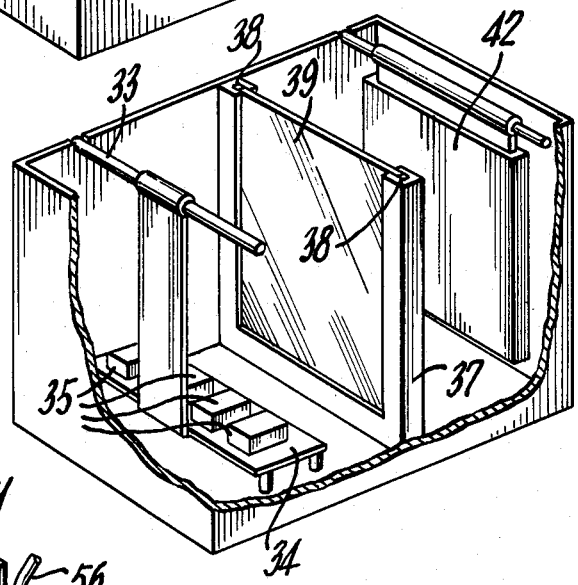
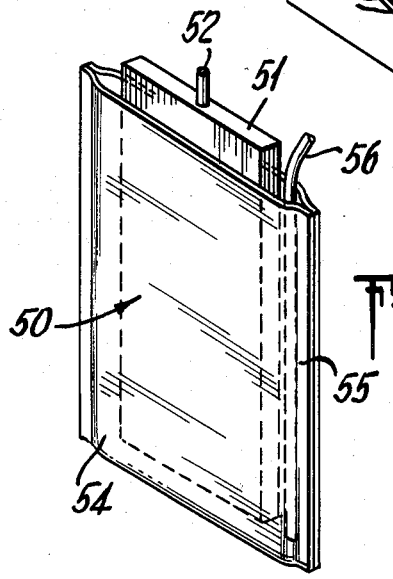
Fig.3.

METHOD AND APPARATUS FOR PURIFICATION OF GOLD

FIELD OF THE INVENTION

This invention relates to gold purification and more particularly to an electrolyte for electrolyzing gold for gold recovery in purified form and a method for electrolytic gold solution and recovery therefrom by chemical means.

BACKGROUND OF THE INVENTION

Crude gold from various industrial sources arrives on the market in ingot form. These ingots consist either of the electrolyzed gold recovered from ores and may contain the usual trade elements associated with such ores; or the anodes may be cast from recycled casting wastes such as sprues, trimmings, polishings and rejected castings. The recycled casting materials contain the various alloying metals used in the jewelry trade. Trace elements and alloying metals should be removed before the gold can be properly reused. The refinery gold and/or the recycled gold is melted and cast into the ingot conveniently shaped for anode use. These ingots usually contain up to about 99% gold.

The method for gold refining which is generally used in the United States mints consists in electrolyzing these crude ingots as gold anodes in hot acid solution of 7 to 8% gold chloride and 10% hydrochloric acid. Current densities as high as 110 amp/ft$^2$ of cathode surface are used. The refined gold (mint grade) is electro-deposited on gold foil or rolled sheet cathodes. The electrolysis cells at the mints and assay offices are constructed of glazed porcelain and/or chemical stoneware. During electrolysis, platinum and palladium, present in fractional parts per million, remain dissolved in the haloacidic electrolyte which also serves to precipitate silver ions as AgCl. To prevent the reduction on the cathode of any AgCl particles in its proximity it has been a practice to surround the anodes with cloth bags. This practice confines the insoluble AgCl away from the cathode. At periodic intervals because of the accumulation of impurities, such as the aforementioned silver, as well as borax silicates and dross, from the anode, the bags are changed and some of the electrolyte is drawn off for purificaiton and replaced by fresh acid and the gold chloride solutions. The gold ions pass through the permeable bags to deposit on the cathode.

Glasstone (Introduction to Electrochemistry, (page 496 suggests that the gold, during electrolysis is in tervalent ionized state in the form of $AuCl_4^-$ ions in the electrolyte solution. The purity of the cathode deposited "mint" gold is about 99%.

The jewelry industry for alloying, plating, casting and similar fabrication procedures, needs purer gold, preferably about 99.95% pure (fine) in order to control the desired physical properties.

It is an object of this invention to provide a method for purifying gold to about 99.95% purity and an electrolyte and apparatus wherein this method can be expeditiously practiced. Included among the ancillary objects of this invention, is the realization of such superfine gold which permits proper control of the physical properties of the gold during its further utilization.

The Invention

The present invention is based upon a process that broadly consists of the steps of electrolyzing the gold in a selective halide electrolyte.

The resultant solution of gold ions is confined and segregated away from the cathode by a semi-permeable barrier that is impermeable to gold ions but is permeable to the halide electrolyte. The electrolyte-insoluble impurities are then separated from the segregated gold solution. This solution is then treated with a selective reducing agent for gold to reduce the gold ions to metallic gold of high purity (99.95%).

BRIEF DESCRIPTION OF THE DRAWINGS

The apparatus aspects of this invention will be described in conjunction with the drawings in which:

FIG. 1 is a perspective view (parts cut away) of one type of apparatus for practicing the invention based upon a semi-permeable anode cup;

FIG. 2 is a side elevation of the cell portion of another apparatus according to this invention, utilizing a planar semi-permeable barrier interposed between the anode and cathode; and FIG. 3 is a side view of a further cell apparatus in which the anode is segregated from the cathode by an envelope of a semi-permeable film segregating the anode.

In the selective electrolyte aspects of this invention, the electrolyte comprises an aqueous solution of a halide ion source containing initially, an impregnating agent. This impregnated gold-electrolyzing electrolyte is known as a pregnant electrolyte. The halide ion source is a concentrated hydrohalide acid in water, or a concentrated halide salt solution. Preferred halide ion sources are 37% hydrochloric acid in water and saturated aqueous sodium chloride (NaCl) solutions.

Of course, hydrobromic acid and hydroiodic acid may be used instead of the hydrochloric acid. The concentrations of such acids may differ but are usually adjusted to provide optimun conductivity under electrolysis conditions.

The salts which can be used instead of sodium chloride (NaCl) are the other monovalent halide salts preferably of alkali metals such as NaBr, NaI, KCl, KBr, KI and possibly but not preferred, the equivalent lithium salts. However the preferred HCl and NaCl are most readily available and are economical. Other metal halide salts may be used but may present problems under the electrolytic conditions practiced herein.

The aforementioned halide solutions are incapable, by themselves, of electrolyzing gold. Gold has an electrolytic potential of about +1.36 volts.

$$Au^{+++} + 3e \rightleftarrows Au \ (+1.36\ V)$$

whereas the halide ions $Cl^-$, $Br^-$ and $I^-$ are respectively +1.358; +1.065; +0.535

| | |
|---|---|
| $\frac{1}{2} I_2 + e = I^-$ | +0.535 |
| $\frac{1}{2} Br_2 + e = Br^-$ | +1.065 |
| $\frac{1}{2} Cl_2 + e = Cl^-$ | +1.358 |
| $Au^{+++} + 3e = Au$ | +1.36 |

(International Critical Tables Vol. 6, p. 332)

Ordinarily the pure elemental halide is liberated before the gold is ionized and thus formation of the soluble gold ion ($Au\ Cl_4$) cannot easily take place. This aspect of the invention is based upon the discovery that the addition of impregnating agents to the electrolyte modifies the overvoltages and/or electrode films, and other electro-potential modifiers in the electrolytic cell to permit the formation of the soluble gold ions upon the imposition of a gold-electrolyzing potential between the metallic gold anode and the cell cathode.

Preferred impregnated agents are oxidizers which sufficiently reduce the overvoltage or modify the anode surface, to permit formation of the soluble gold ion without liberation of the elemental halide or noxious gases from the impregnating agents.

Optimum impregnating agents are the peroxides, optimally hydrogen peroxide, but other sources, such as ozone, which liberate the nascent oxygen at the anode will also serve.

While nitric acid and similar nitrogen oxidizers will impregnate the electrolyte, actually forming a dilute aqua regia with HCl, they are not preferred as they liberate noxious nitrogen oxides at the anode upon the imposition of sufficient EMF to electrolyze the gold. Perborates and perchlorates may be used but borates tend to precipitate from solution as a dross and the perchlorates may pose explosive hazards if not properly handled.

Peroxide, $H_2O_2$, as the impregnating agent is a true catalyst as it is merely needed to initiate the electrolyzing of the gold. As little as one part per million of $H_2O_2$ is sufficient to initiate electrolyzing of the gold. No advantage has been found for concentrations of $H_2O_2$ above about 0.5% and such higher concentrations may interfere with the later separation of gold from its impurities.

Other oxidizers such as chromic acid and permanganates offer no advantages and present problems during further purification steps. Once the electrolyte has been impregnated, and electrolysis current applied, the electrolyte solution becomes pregnant or gold bearing. This pregnant solution is itself an electrolysis initiator but, of ocurse, it requires an impregnating agent to be formed initially.

In the present invention, the refinery gold in the form of the aforementioned gold ingots of varying purity is made the anode in the special electrolysis cell of this invention. The cell is arranged in such a manner that the gold ions electrolyzed into the electrolyte are confined in a portion of the electrolyte which is segregated from the cathode so that the dissolved gold cannot be plated out on the cell cathode. This segregation and confinement is achieved by interposing a semi-permeable barrier between the anode and cathode. This causes the separation of the electrolyte into an anode electrolyte portion and a cathode electrolyte portion.

The initial solution of halide ion source and peroxide is introduced into the electrolyte cell which consists of the gold anode, the electrolyte and a cathode. The anode and cathode are each electrically in contact with a properly polarized EMF source. Under normal conditions the electrolyzed gold, electrolyzed by the impregnated electrolyte, would be deposited unto the cathode. This direct electrolysis with the novel pregnant peroxidized electrolyte of this invention is feasible and is novel in its initial condition.

However, according to a further aspect of this invention, the gold is electrolyzed from the gold anode made up of gold ingots, into a halide-ion, electrolyte portion which is segregated from the cathode by a semi-permeable membrane or barrier. This segregated electrolyte portion is denoted as the anode electrolyte portion. This membrane is semi-permeable in that it is impermeable to the gold ions formed during electrolyzing of the anode and is permeable to the lighter halide ions in the electrolyte. This permeability to the halide electrolyte ions ensures the conductivity of the cell and access of the requisite halide ions needed to form the gold ion at the anode. It also segregates the gold ions from the cathode and prevents the electrodeposition of metallic gold thereon.

The semi-permeable barriers useful for the practice of this invention are those that are permeable to the smaller electroconductive ions in the electrolyte and are impermeable to the larger and heavier gold-containing ions. The acid electrolytes, with HCl being preferred, are used in aqueous concentrated form such as the commercial 37% HCl; the salt electrolytes are preferably used as saturated aqueous solutions. To complete the electrolyte and to make it functional for electrolyzing the gold, it is necessary to add the impregnating catalyst to the electrolyte. The catalysts are generally oxidizing agents that do not add interfering ions to the electrolyte. The preferred catalysts are inorganic and organic peroxides with hydrogen peroxide being preferred, but ozone gas or an ozonide source of nascent oxygen may also be used. The electrolyte becomes pregnant, i.e., gold bearing upon imposition of an electrolyzing current. As little as one part per million of $H_2O_2$ or its equivalent is sufficient when added to the halo-acid or halide salt electrolyte upon, or just prior, to initiation of electrolysis. Its presence causes the attack and electrolyzing of the gold anode.

The peroxide catalyst is initially introduced in very small amounts. One to five drops of 100-volume hydrogen peroxide per gallon of electrolyte are sufficient.

In the absence of the impregnating catalyst, the "virgin" electrolyte cannot initiate the electrolysis or dissolve the gold anode. It is speculated that the impregnating catalyst breaks down any polarizing films and that any appreciable amount of gold ion $AuCl_4^-$ once formed, maintains the pregnancy of the electrolye.

It has been found that the upper limit for peroxide addition is about 0.5 to about 1% by volume. At that high peroxide level, it has been noted that gold ions are not easily separated from solution. The peroxides act as true electrolyzing catalysts as they are needed only to initiate the proper electrolyte reaction. Replenishing the electrolyte levels can be performed without any further addition of catalyst to the added material. Actually, the resulting gold-containing solution then promotes further electrolysis of the gold. In the absence of peroxide or the gold ions resulting from the peroxide initiation, the gold in the anodes is not successfully directly electrolyzed. During the electrolysis in the pregnant electrolytes, ionization of the gold is initiated.

According to a principal feature of this invention, the resulting gold ions are segregated in a portion of the electrolyte that is kept away from the cathodes by the semi-permeable barrier. This prevents the gold from plating out on the cathode. The gold ions are kept in solution in the segregated anode portion of the electrolyte. The rest of the electrolyte is devoid of gold ions and, in fact, of any precious metal ions. Its conductivity is based on the halide anions and hydrogen ions from the acid and the light cations, such as the Na, K, etc., from the halide salts. In the presence of the pregnant electrolytes of this invention, there is little or no gas discharge at the cathode.

The conductive inert cathodes are preferably made of conductive carbon preferably graphite.

The current density in the cell of this invention is as high as possible, comparable to those used in the "mint" process, i.e., in the range of about 100 A/ft.$^2$. Lower currents may be used but offer no advantage. Heating of the electrolyte due to the high currents is advantageous. It insures proper agitation in both electrolyte portions and particularly in the salt-type electrolytes, where saturation is maintained in the hot solution. The volume of the electrolytes are maintained. Any evaporated water is replaced before the conductive electrolytic salts can precipitate from the solution. An operating temperature of about 180° F. is satisfactory and preferred.

Semi-permeable barriers useful for this invention should have a pore size of 0.5$\mu$ (micron) or less. Pores greater than about 0.5 microns are permeable to the gold ions formed at the anode. At such larger pore sizes it has been noted that some gold is deposited on the cathode. At 0.5$\mu$ no gold is deposited and the conductivity of the cell is maintained. At smaller pore sizes, (two orders of magnitude, 0.005$\mu$) cell conductivity is reduced.

The semi-permeable barriers can be fabricated from ceramic, polymeric or metallic materials capable of being fabricated to proper shape in substantially uniform pore size. Such barriers, in various shapes are commercially available. Ceramic cups and plates of many sizes and shapes of the proper pore size are listed in the commercial catalogs of manufacturers of laboratory filter cups and plates such as Coors and Norton. Barriers of suitable semi-permeability have been fabricated from supported fluorocarbons such as "Teflon" and semi-permeable polymeric films of celluloxanthate such as acid-resistant "Cellophane". Similar cups and plates can be fabricated to proper pore size by powdered metallurgy methods from stainless alloys such as monel metal or "Stellite". By proper prevention of conductivity contact of such low electrical conductive alloys with the anode or cathode, these can be used without contamination of the electrolyte. These ceramic, polymeric or metallic porous materials can be fabricated into cups or plates or semi-permeable films thereof can be used to wrap around either the anode or cathode depending on the particular design to form separators of the electrolyte into portions.

In small cells it is useful to surround the anode with the semi-permeable barrier in the form of cups. These anode cups, permeable to the conductive, pregnant halo-electrolyte are impermeable to the dissolved gold ions. Any silver, usually present to about 5% of the gold ingots, when electrolyzed with the gold from the ingot, will form insoluble silver chloride which precipitates from solution. When the gold chloride content of the solution within the anode cups is deemed sufficient, over about 10 wt. %, it is removed from the cell to another vessel either by transfering the cup and its contents from the cell or pumping the contents of the cup from the cell, where in another vessel a separation process takes place. In addition to the segregated electrolyte, containing dissolved gold, the anode cup also contains a sludge of the insoluble silver halide, usually silver chloride and any dross from the ingot such as insoluble silicates and boron salts. Some of the precipitated impurities float in the electrolyte and others, depending on the ultimate oxidation of these salts, remain suspended or sink to the bottom. The insoluble silver halides may also be suspended or may precipitate.

These insoluble sludge impurities when transferred from the cell are separated from the gold-containing solution by any suitable means for separating the insolubles from the solution. Filtration or centrifugation are excellent for removing the insolubles from the gold-containing liquidus. Filtration is a preferred separation means. The separated silver-containing solids are retained for further treatment, the recovery of the silver.

The filtrate contains all the gold ions dissolved in the halo-electrolyte together with dissolved traces of platinum and palladium.

Another novel aspect of the invention is the precipitation of electrolyzed gold obtained from the pregnant electrolyte and its filtrate by the addition of selective reducing agents, preferably dissolves sulfite solutions. Preferred for this precipitation, in order that the precipitated gold be of the highest purity is reagent grade $NaHSO_3$. When this precipitant is added to the gold solution, the gold ions are reduced to the metal state and precipitate in high purity, at least 99.95%.

According to this varient aspect of the invention, it provides a purified gold from gold anodes derived from refineries or from recovery systems and encompasses the steps of forming, in an electrolytic cell, the segregated gold-ion-containing anode portions of pregnant electrolyte, transferring or removing this segregated gold-containing electrolyte portion from the cell; separating the insoluble impurities from the dissolved gold in the removed portion, by separation steps such as filtrating or centrifuging. The filtrate contains the dissolved gold, together with halide-soluble metal ions usually present from the ores or from alloy recovery; such as platinum metals, i.e., platinum, palladium, and rhodium; copper, nickel and chromium. Precipitated and removed with the insoluble silver will be the other halide-insoluble ions including mercury and lead. The precipitated sludge can be accumulated and then separated by well-known methods for recovery of the economically valuable silver and or mercury.

The filtrate containing the desired ionized gold complexes and aforementioned platinum and alloying impurities is then treated to selectively reduce the gold complexes to metallic gold. Considering the EMF of gold almost any reducing agent would be sufficient to form metallic gold from the gold complexes but the stronger reducing agents including ferrous sulfate (copperas), and sodium borohydride, would also reduce and co-precipitate some associated alloying impurities from the filtrate. Such co-precipitations, of course, would defeat the purifying aspects of this invention. By utilizing the very weak reducing action of bisulfite ion ($HSO_3^-$) the selective precipitation of metallic gold in 99.95+% purity is regularly achieved. The solute, after removal of the metallic gold, contains the dissolved alloying platinum metals and undesirable elements. The solute may be further treated, for recovery of the platinum metals, if warranted; or disposed in an ecologically acceptable manner.

According to a variant of the apparatus aspect of this process, the anode portion of the electrolyte can be segregated from the cathode portion by a planar semi-permeable barrier subdividing the cell. The proportions of cell volume in the respective anode and cathode portions of the cell are dependent upon the type of transfer means to be used to transfer the gold ion-containing solution from the cell to the separation stage. In the interest of efficiency, if the transfer is to be in batch-wise stages, the anode portion is kept large. If the gold ion-containing solution is to be continuously pumped to the separation stage, then it is most advantageous to keep the anode portion small in order to improve the rate of gold solution and its concentration in the electrolyte. As the liquid in the anode portion is kept agitated by the electrolysis effects, the precipitated solids, including the silver chloride are kept suspended in this liquidus and are transferred to the separation vessel therewith.

DETAILED DESCRIPTION

The electrolytic cell can be fabricated from any of the commonly used materials for plating baths such as glass jars, plastic vats, fiberglass tanks, wooden tanks, supported neoprene or rubber tanks, glass-lined steel tanks, etc., All are available to the plating industry in various sizes and configurations suitable for the practice of this invention. It is also useful, where the invention is to be practiced on a small scale, to configure the entire apparatus into a single unit. Such units are useful in small casting shops where the pure gold is prepared as needed for custom alloying prior to casting. FIG. 1 detailed below, includes the plating section with its semi-permeable anode cup surrounding the gold ingot and its associated cathode; a separation section where the transferred gold-bearing anode electrolyte and its soluble and insoluble impurities are filtered to provide a silver-containing sludge and a gold-bearing filtrate. The unit also includes a separate precipitation section where the gold-containing filtrate is preferably treated with a bisulfite, $HSO_3^-$ ion solution to reduce the gold from its dissolved state to its metallic form. It may be plated out here on a suitable cathode from this filtrate as well. A utility compartment, contains (a) the pump for transferring the anode electrolyte portion from the anode cup to the filter in the separation section; (b) the pump for transfer of the filtrate from the separation section to the precipitation section; (c) vacuum sources for operation of the filter; (d) transformers and rectifiers for the electrolyte cell. Ancillary current and temperature controllers for the electrolysis and precipation sections, as well as storage tanks for the bisulfite precipitating solution are also provided in the utility section of this unitary apparatus.

In larger scale operations, the unity of the three functional apparatus sections for the operation of the invention; the electrolytic cell, the separation section with filtration apparatus and the precipitation section can be maintained in a unified apparatus with the ancillary apparatus including electrical means, transfer means and solution sources being supplied from the outside sources. On laboratory or much larger industrial scale operations, each of the unit operations which in the novel disclosed combination comprise an aspect of the invention, can be practiced sequentially in separate vessels of appropriate form and size.

DETAILED DESCRIPTION OF THE DRAWING

FIG. 1 illustrates a unitary self-contained commercial apparatus useful for practicing the invention where sufficiently high purity gold can be prepared for single piece castings, i.e., about 1 to 2 oz. of gold per batch.

In this self-contained apparatus 25, including the electrolytic cell 10, the separation compartment 21, the precipitation compartment 22 20; the elctrolytic cell compartment 10 occupies the long dimension of the apparatus with the other compartments positioned behind this cell. The gold anode 14, connected and suspended from anode terminal 13 is suspended in cell 10 and immersed in electrolyte 11 to an electrolyte level 12, covering most of the surface of the anode 14. The anode 14 is surrounded by the anode cup 15 made of semi-permeable ceramic material. As this cup material is semi-permeable to the water and the salt or acid ions contained therein, the electrolyte level 11 within the cup 15 at the anode 14 is the same as outside the cup. The electrolyte 11 for use in this small scale apparatus 25 is preferably a saturated NaCl solution, saturated at 180° F. It is preferred to introduce the electrolyte 11 to cell 10 in heated form or at least to preheat it before initiating operation of the cell. When fresh electrolyte 11 is introduced into empty cell 10, just prior to starting the flow of current, one to two drops of 100 volume hydrogen peroxide is added to the electrolyte. It may be added to the bulk electrolyte 11 filling cell 10 or to the electrolyte 11 in anode cup 15 surrounding anode 14. At a proper distance from the anode 14 is positioned the cell cathode 17, connected to its respective cathode terminal 16. Cathode 17 is chemically inert to the electrolyte 11 and is fashioned from a conductive carbon, preferably graphite. In the unit 25 of FIG. 1 designed for small scale operation, the anode cup 15 is made of ceramic material having a pore size not greater than 0.5 micron. and an internal volume of about 120–150 ml. The cup 15 is immersed in the electrolyte to a level so that it contains about 100 ml of the electrolyte. This is sufficient for the electrolysis of gold anodes weighing up to about one ounce. Such a cup is commercially available from Coors Ceramics, catalog No. 60495, has a nominal capacity of 100 ml, and is about 2 inches in diameter and 4 inches high.

In this small apparatus the cell is operated at 180° F. at about 2 to 25 Amps, preferably at about 15 to 20 Amps.

After the gold ingot has had sufficient gold dissolved in the electrolyte, the anode cup is removed from the cell and its contents containing all the dissolved gold is transferred to the separation compartment 21 of the apparatus 25. In the separation compartment are positioned a filter funnel with a filter 18 sitting atop a filter flask 19 connected to a vacuum source in the equipment compartment 20.

The dross and silver chloride are removed from the transferred anode contents. The filtrate then contains all the electrolyzed gold together with other solubles. In addition to the gold, the filtrate contains minor amounts of platinum, palladium and rhodium usually present and associated in the gold ingot in several parts per million quantities and alloying elements when the anodes are from recovered gold.

The filtrate from flask 19 is then transferred to the precipitation compartment 22 where a solution containing bisulfite ion is added to reduce the gold ions to metallic form. The gold precipitates as a dense power which is filtered off and, after water wash, assays at least about 99.95% purity. It is suitable for further use.

Ceramic cups suitable for use as semi-permeable anode cups are available in sizes holding up to about one gallon. The porous material with pore size of less than half a micron used to make the anode cups is also available in the form of flat plates of various sizes. FIG. 2 shows an electrolytic cell useful for the practice of this invention and modified to utilize such flat plates to segregate the electrolyte into anode and cathode portions. The gold, as it is electrolyzed, is confined to the anode portion of the electrolyte.

The plate 39 is inserted within a grooved recess 37 in the cell and is sealed to the groove by rubber tube 38. Since such cells permit electrolysis of larger amounts of gold and greater anode electrolyte portions, it is useful to modify the anode 32 by providing an anode shelf 34 of conductive carbon or graphite connected to anode terminal 33 and on said conductive shelf 34 are positioned the gold ingots 35. The rate of electrolysis is adjusted to get the highest efficiency by electrolyzing the gold against graphite cathodes 42 at high current densities but just below rates at which hydrogen is liberated at the cathode surface. Gases liberated at the cathode surface cut the efficiency of the electrolysis.

FIG. 3 shows a variant anode assembly 50 wherein, the gold ingot 51 as anode is connected to anode terminal 52 and is surrounded by envelope 54 fashioned from a semi-permeable membrane 54 and heat sealed around the ingot 51 at seam 55. To provide continuous removal of gold ions upon electrolysis, tube 56 is positioned alongside ingot 51 with its intake along the bottom of envelope 54. The electrolyte is pumped therefrom by tube 56 and led to appropriate separation and precipitation apparatus.

In the practice of this invention the gold ingots 14, 35, and 51 are electrically connected to the anode terminals and the current is turned on. The gold ingots electrolyze into the pregnant NaCl or HCl electrolytes forming gold ions therein. The gold ions in the electrolyte are segregated from the cathode by the semi-permeable barriers 15, 39, and 53. As gold ions accumulate in the electrolyte they remain dissolved therein until sufficient concentrations for recovery are reached. Usually the gold ion concentration in NaCl, based on dissolved gold, is continued to about 1 oz. to 100 ml of electrolyte in the cup 15 and is useful for further recovery. The anode electrolyte may be removed from the segregated anode electrolyte portion in a single batch or it may be continuously withdrawn and the electrolyte volume maintained by addition from an $H_2O_2$ activated electrolyte reserve. In 400 ml segregated anode portions for continuous operation, the gold ion concentration reached 1 oz./400 ml of 37% HCl. In larger scale operations the gold is permitted to accumulate to about 10 ozs. per gallon before removal to the separation stage.

The removed electrolyte is then separated from the accumulated insoluble impurities by separation means such as filters or centrifuges. The liquidus separated from the impurities is then treated with a reducing agent for gold, containing $HSO_3^-$ ions. Sodium bisulfite solutions are the preferred reducing agents. They reduce the dissolved gold ions to gold metal which, of course, is insoluble in the resulting liquid mixture. The "of course," is based on the combined absence of an electrolytic potential and an impregnating agent. The sulfite precipitant is very efficient, leaving the gold in solution at less than 1 part per million concentrations. Remaining in solution are small dissolved levels of the precious metals, platinum, palladium and rhodium. If sufficient amounts of these dissolved materials have accumulated, after gold removal they can be precipitated by adding metallic zinc to the acidic solution. The final residual solutions can be tested for any gold or precious metal residues by the use of stannous chloride test reagent. This test can determine residues down to parts per billion. Also remaining in solution, in cases where the anodes are fashioned from recovered alloyed gold are the halide soluble nickel, copper, zinc and chromium. Recovery of these alloying metals is usually not economically interesting. They are precipitated as their sulfides and ecologically disposed.

The invention has several associated aspects which include:

1. The novel electrolyte for electrolyzing gold which comprise an aqueous solution of a halide ion-source containing initially an impregnating agent. Included in this aspect are the halide sources, with concentrated hydrochloric acid and saturated sodium chloride solutions being preferred, and hydrogen peroxide in excess of one part per million as the preferred impregnating agent. A variant of this aspect is the method of electrolyzing gold in this novel pregnant electrolyte by applying a sufficient gold electrolyzing EMF between a gold anode and a cathode.

2. Another novel aspect of this invention is the feature of segregating the gold solution obtained by electrolyzing the gold anodes against a cathode in the pregnant electrolyte and segregating the resulting ionic gold solution in an anode electrolyte portion enclosed and separated from the cathode by a semi-permeable barrier membrane that is impermeable to the passage of gold ions and is permeable to the impregnated electrolyte so as to prevent deposition of gold at or on the cathode.

3. Another aspect of the invention is directed to recovering, in purified form, the electrolyzed gold from the segregated anode electrolyte portion by the use of a selective reducing agent solution for gold, preferably a bisulfite ion source.

A variant on the above aspect is the recovery of the ionized gold solubles from the segregated electrolyte portion by electrolytic deposition of the gold liquidus on a cathode in very pure form.

The various aspects can, of course, be combined into a unified gold purifying process which combines the steps of electrolyzing gold in an impregnated chloride solution while segregating the resultant anode ionized gold solution in said impregnated electrolyte from the cathode by a semi-permeable barrier, filtering off any chloride-insoluble impurities from the segregated ionic gold solution; precipitating metallic gold from the filtrate by the addition of sufficient sodium bisulfite thereto and removing the metallic gold from the solute which retains any soluble (non-gold) impurities.

A further aspect of this invention resides in the unitary apparatus for carrying out the above steps which comprises an electrolysis section, a separation section, a precipitation section and an associated utility section, said electrolysis section comprising an electrolyte-containing vessel, an anode of the gold to be purified immersed in the electrolyte, said electrolyte being impregnated (catalyzed) with an impregnating oxidizing agent; semi-permeable barrier means for sequestering the portion of the electrolyte adjacent to said gold anode from the electrolyte adjacent to said cathode, said barrier being semi-permeable, i.e., permeable to halide ions and impermeable to gold ions and other heavy ions by having a pore size of less than about 0.5 micron; said separation section containing separation means such as filters or centrifuges for removing the insolubles from the gold-containing anode portion liquidus transferred thereto; and a precipitation section to which said filtered liquidus is transferred, containing a vessel therefore and a source of bisulfite reducing solution for adding to said liquidus in said vessel to reduce the gold ions to metallic gold and means for recovery of the metallic gold from the supernatant solute containing any soluble impurities; said unitary apparatus including a utility section including an electrolyzing current source, transfer means for transfer of segregated electrolyte to said separation section, additional transfer means for transfer of the liquidus to the precipitation section and for transfer of the gold-free solute to disposal means as well as reducing agent storage means and supplies including vacuum sources for said separation, reduction and recovery of the purified metallic gold.

All the above aspects are herein generically disclosed and all art-recognized equivalent steps, means, and compositions are intended which serve the stated purpose of the invention.

As can be seen, the present invention provides a significant advance over the state of the technology. As numerous modifications and constructions can be performed within the scope of the invention, such scope is measured by the claims herein.

What is claimed is:

1. A halide electrolyte for electrolyzing solid metallic gold anodes comprising an aqueous solution of a halide ion source, containing, initially, an impregnating agent for modifying the electropotential of the metallic gold upon initiating electrolysis, and thus forming upon electrolysis a pregnant electrolyte for continuously forming gold ions: said impregnating agent being a nascent oxygen source added as a compound in an amount of between one part per million and 0.5% by volume of said electrolyte

2. The electrolyte according to claim 1, wherein said halide ion source is selected from the group consisting of substantially saturated chloride solutions and concentrated hydrochloric acid solutions.

3. The method of forming a pregnant electrolyte for electrolyzing gold, which comprises the step of applying an electromotive force greater than 1.36 volts between a gold anode and a cathode in an electrolyte comprising an aqueous solution of a halide ion source, containing, initially, an impregnating agent for modifying the electropotential of the metallic gold upon initiating electrolysis, and thus forming upon electrolysis a pregnant electrolyte for continously forming gold ions: said impregnating agent being a nascent oxygen source present in an amount of between one part per million and 0.5% by volume of said electrolyte.

4. The method of forming segregated ionic gold solutions which comprises the steps of (a) inserting a solid metallic gold anode and an inert cathode into a pregnant electrolyte prepared according to claim 3;

(b) separating said electrolyte into an anode portion and a cathode portion by interposing a semi-permeable barrier into said electrolyte between said anode and cathode, said barrier being impermeable to gold ions in solution but permeable to anions and light metal cations (c) electrolyzing said anode against said cathode to form an ionic gold solution segregated in said anode electrolyte portion by said barrier; and thus (d) preventing the deposition of gold upon said cathode by segregating said ionic gold from the inert cathode.

5. The method of recovering purified metallic gold from the segregated ionic gold solution prepared according to claim 4, which comprises the steps of (a) separating at least a portion of the gold-containing solution from said anode portion;

(b) removing any chloride-insoluble impurities derived from said gold anode from said portion and; then, (c) selectively precipitating metallic gold from the separated ionic gold solution portion by the addition thereto of a selective reductant for gold delected from the group consisting of bisulfite solutions, sodium borohydride, copperas solutions, and oxalic acid solutions.

6. The method according to claim 5, whrerein the selective reductant for the ionized gold is a solution of a bisulfite ion.

7. The method according to claim 6 for purifying gold, which comprises the steps of (a) electrolyzing gold into a pregnant, chloride electrolyte while (b) segregating the resultant ionic gold solution in said chloride electrolyte from cathodic deposition;

(c) filtering any chloride-insoluble impurities from said segregated solution;

(d) precipitating metallic gold from the filtrate by the addition of a solution of sodium bisulfite thereto and (e) then removing the pure metallic gold from the solute containing any soluble impurities.

8. A method for purifying gold which comprises the steps of (a) electrolyzing the gold to be purified as a solid metallic anode, in a halide-containing electrolyte initially including a peroxide source, in a concentration of of 1 part per million to about 0.5% by volume, against an inert cathode by the application of a gold-ionizing EMF;

(b) segregating the resulting ionic gold and electrolyzed impurities from the inert cathode in an anode electrolyte portion by interposing a semi-permeable membrane between said anode and said cathode, said membrane being permeable to the halide ions of the electrolyte and impermeable to the gold and heavy metal ions formed and dissolved in said anode portion;

(c) transferring the liquid containing the segregated electrolyzed gold and any contained halide-insoluble impurities from said anode portion to separation means; .

(d) separating the insoluble impurities from the transferred solution;

(e) and than reducing and precipitating gold in metallic form of at least 99.95% purity from the separated solution by the addition thereto of a solution of dissolved bisulfite ions.

9. The method according to claim 8, wherein said halide-containing electrolyte comprises a nascent oxygen source selected from the group consisting of ozone, hydrogen peroxide solutions, urea peroxide,

10. The method according to claim 8, wherein the insoluble impurities in said anode electrolyte portion include silver which upon electrolysis in the halide-containing electrolyte forms the insoluble silver halide.

11. The method according to claim 8, wherein the inert cathode is a conductive carbon element.

12. The method according to claim 8, wherein said solution of dissolved bisulfite ions is a solution of sodium bisulfite.

13. A unitary apparatus for the recovery and purification of gold said apparatus comprising an electrolysis section, a separation section, a precipitation section and a utility section;

said electrolysis section comprising an EMF source, an electrolyte-containing vessel, an anode of the solid metallic gold to be purified connected to said source and immersed in the electrolyte, an inert cathode connected to said EMF source and immersed in said electrolyte, said electrolyte containing halide ions and a nascent oxygen initiating-catalyst for forming auric chloride ions; semi-permeable barrier means for segregating the gold ion-containing portion of the electrolyte adjacent to said anode from the electrolyte adjacent to said cathode; said barrier being permeable to the halide ions and impermeable to gold and other heavy ions;

said separation section containing means for separating the soluble materials from any insoluble materials contained in the segregated anode electrolyte portion that has been transferred to said separation section, and, containing soluble ionized gold and electrolyte insoluble impurities;

said precipitation section including a vessel wherein the soluble gold-containing material transferred from said separation section to said precipitation section comprises means for the addition thereto of a bisulfite ion source to reduce and precipitate metallic gold in purified form;

said utility section containing electrical current source means for generating the EMF for said electrolysis section, transfer means for transfer of liquids between the electrolysis section, separation section and precipitation section.

14. The apparatus according to claim 13, wherein said semi-permeable barrier has a pore size of approximately 0.5 micron.

15. The apparatus according to claim 13 wherein said separation means in said separation section is a filter apparatus for separating insoluble impurities, including silver halide from the containing filtrate.

16. The apparatus according to claim 13, wherein said precipitation section includes recovery means for recovering the metallic gold precipitate from the liquidus.

17. The apparatus according to claim 13, wherein the semi-permeable barrier material, separating the anode from the cathode and subdividing the electrolyte into cathode and anode portions, is fabricated from ceramic, polymeric and metallic materials of substantially uniform pore size in the range0.5 microns to 0.005 microns.

* * * * *